US006056643A

United States Patent [19]

Wilmoth, III

[11] Patent Number: 6,056,643

[45] Date of Patent: May 2, 2000

[54] EXPANDABLE BATON

[76] Inventor: Clark L. Wilmoth, III, 501 E. Orangethorpe, #15 Pine Via, Anaheim, Calif. 92801

[21] Appl. No.: 09/211,471

[22] Filed: Dec. 14, 1998

Related U.S. Application Data

[60] Provisional application No. 60/069,624, Dec. 15, 1997.

[51] Int. Cl.[7] ..... F41B 15/02

[52] U.S. Cl. ..... 463/47.7; 135/75

[58] Field of Search ..... D22/117; 463/47.2, 463/47.7; 135/75

[56] References Cited

U.S. PATENT DOCUMENTS

| | | | |
|---|---|---|---|
| 83,228 | 10/1868 | Warne . | |
| D. 333,692 | 3/1993 | Parsons | D22/117 |
| D. 395,069 | 6/1998 | Starrett | D21/117 |
| 2,757,002 | 7/1956 | Ryden . | |
| 4,037,839 | 7/1977 | Nelson | 273/84 |
| 4,819,137 | 4/1989 | Hamilton . | |
| 5,110,375 | 5/1992 | Parsons | 148/534 |
| 5,149,092 | 9/1992 | Parsons | 273/84 |
| 5,160,140 | 11/1992 | Starrett | 273/84 |
| 5,320,348 | 6/1994 | Starrett | 273/84 |
| 5,348,297 | 9/1994 | Parsons | 273/84 |
| 5,407,197 | 4/1995 | Parsons | 273/84 |
| 5,509,581 | 4/1996 | Parsons | 222/153.13 |
| 5,568,922 | 10/1996 | Siddle | 273/84 |
| 5,617,980 | 4/1997 | Parsons et al. | 224/251 |
| 5,657,986 | 8/1997 | Parsons | 463/427 |
| 5,667,441 | 9/1997 | Parsons | 463/47.7 |
| 5,690,552 | 11/1997 | Siddle | 463/47.7 |

*Primary Examiner*—William M. Pierce

*Attorney, Agent, or Firm*—Andrus, Sceales, Starke & Sawall

[57] ABSTRACT

An expandable baton having a gripping tube, a center tube, and a striking tube that collapse into an axial bore formed in the gripping tube. The gripping tube includes an extended support surface formed on the decreasing diameter tapered portion contained on its first end. The center tube includes an extended support surface on each of its first and second ends to prevent fracture on each of the ends during use of the baton. The striking tube is machined and includes a tapered portion formed on its second end that engages the center tube when the baton is in its extended position. An end cap having an outer diameter greater than the inner diameter of axial bore formed in the gripping tube is attached to the first end of the striking tube. The end cap includes a nesting portion having a nesting surface that engages the inner diameter of the axial bore of the gripping tube when the baton is in its retracted position. An angled surface on the end cap aids in aligning the striking tube within the gripping tube.

20 Claims, 2 Drawing Sheets

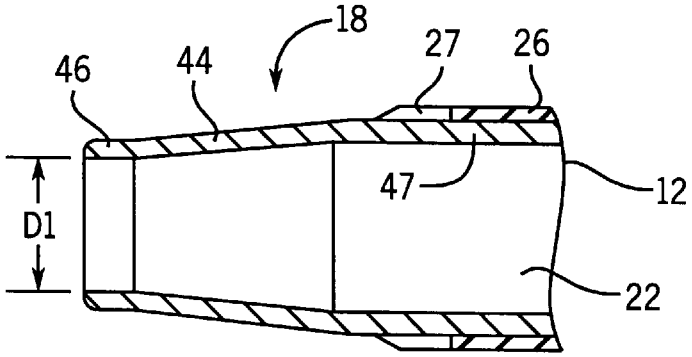
FIG. 5
FIG. 6
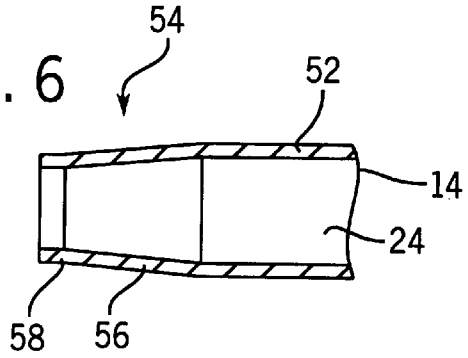
FIG. 7
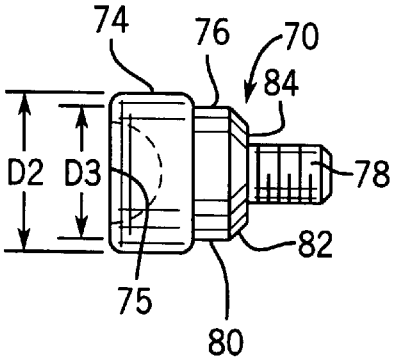

EXPANDABLE BATON

CROSS REFERENCE TO RELATED APPLICATION

This application is based on and claims priority from provisional patent application Ser. No. 60/069,624 filed on Dec. 15, 1997.

BACKGROUND AND SUMMARY OF THE INVENTION

The present invention generally relates to expandable batons or night sticks used by law enforcement personnel. More specifically, the present invention relates to a three section, telescoping baton having a larger diameter end cap and strength enhancing features.

Expandable batons have been used for many years by law enforcement officer as a convenient alternative to conventional one-piece batons or night sticks. When in the retracted position, expandable batons can be worn in a holster attached to the equipment belt of law enforcement officer without interfering with the movement of the officer. Additionally, when retracted, the expandable baton can be somewhat concealed by the officer to reduce his or her threatening appearance when confronted with a delicate situation.

Expandable batons typically include an outer gripping tube that acts as the handle for the baton when the baton is in the extended position. One or two telescoping sections nest within the gripping tube such that the retracted length of the expandable baton is approximately ⅓ of its extended length. During use, the baton is sharply swung in an arc such that the inner telescoping sections are flung outward by the centrifugal force generated during the swinging action. Typically, each of the telescoping sections include an expanded end that interacts with a tapered surface formed on the outer section to frictionally lock the baton in its extended position.

Although currently available expandable batons work reasonably well, several problems exist. Since the expandable baton must be worn by the law enforcement officer, it is desirable to have a baton that weighs as little as possible without compromising the structural strength of the baton in its extended position. In order to create batons having low overall weights, the individual telescoping sections are oftentimes made from relatively soft metal that is subject to several processing steps during which the material is hardened. An example of a baton formed in this manner is shown in Parsons U.S. Pat. No. 5,110,375. The heat treated alloy steel used to form this type of baton has the required strength but becomes increasingly brittle and can fracture during the extension thrust.

Additionally, many expandable batons include an end cap on the smallest diameter striking tube that is received within an axial bore formed in the larger diameter gripping tube when the baton is in its retracted position. The interaction between the end cap and the gripping tube retains the baton in its retracted position and prevents the baton from rattling. However, when such a baton is used to poke or prod a suspect, the relatively small end cap can cause puncture wounds if enough force is applied to the baton.

Therefore, a need exists for an expandable baton having increased structural strength characteristics and an improved end cap that prevents injury during use. It is a further object of the invention to provide an expandable baton that includes an extended support surface on the end of each telescoping section to increase the structural integrity of the telescoping section and prevent fracture or separation of the tubes during use. It is a further object of the invention to provide a striking tube that is machined. It is an additional object of the invention to provide an end cap having an outer diameter larger than the diameter of the inner surface of the axial bore formed in the gripping tube such that the end cap extends outward past the end of the gripping tube when the baton is in the retracted position. It is a further object of the invention to provide an end cap having a nesting surface that interacts with the inner surface of the axial bore formed in the gripping tube to aid in retaining the expandable baton in its retracted position. It is a further object of the invention to provide an angled surface on the end cap that aids in the alignment of the striking tube within the gripping tube.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 5 is a partial section view of the first end of the gripping tube of the expandable baton;

FIG. 6 is a partial section view of the first end of the center tube of the expandable baton; and FIG. 7 is a side view of the end cap of the expandable baton.

DETAILED DESCRIPTION OF THE INVENTION

Figure 1:
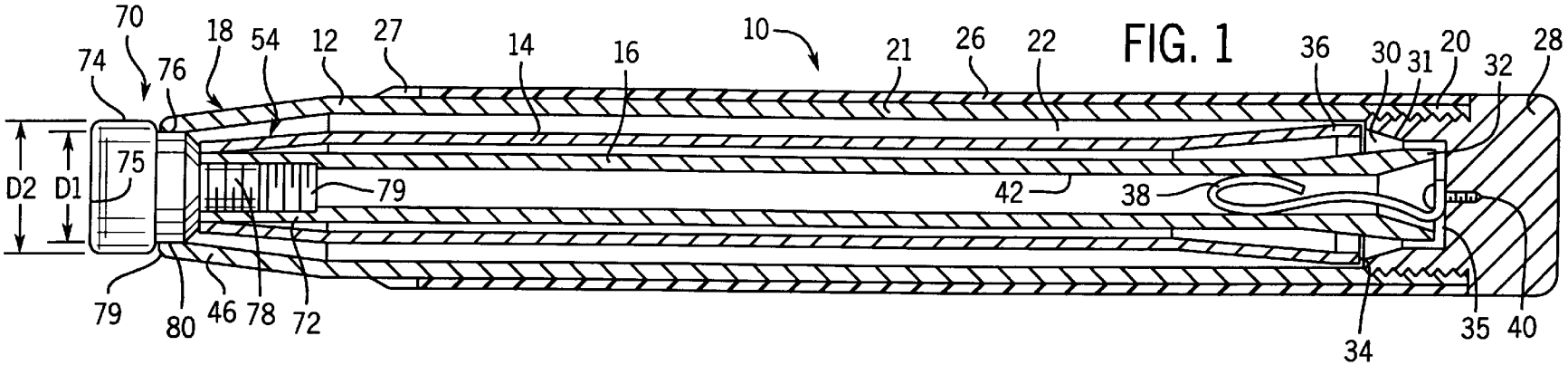
FIG. 1 is a longitudinal section view of an expandable baton of the present invention in the retracted position.
Figure 2:
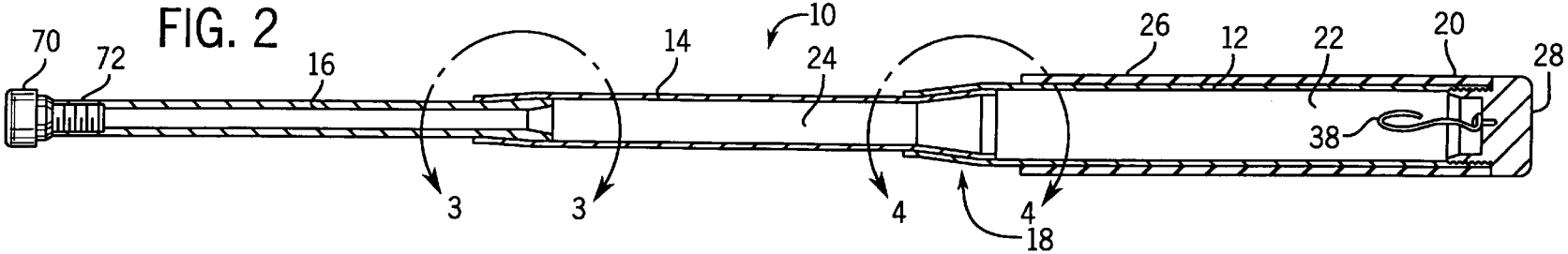
FIG. 2 is a longitudinal section view of the expandable baton of the present invention in the extended position.

FIGS. 1 and 2 generally illustrate an expandable baton 10 of the present invention. The baton 10 is expandable between the retracted position shown in FIG. 1 and the extended, operative position shown in FIG. 2. In the preferred embodiment of the invention, the baton 10 has an overall length between 21 and 29 inches in the extended position and has a retracted length between approximately 8 and 11.5 inches, although other sizes for the baton 10 are contemplated.

The baton 10 generally includes a gripping tube 12, a centertube 14, and a striking tube 16. The gripping tube 12 extends longitudinally between a first end 18 and a second end 20 and includes an outer wall 21 that defines an axial bore 22. The axial bore 22 formed in the gripping tube 12 is sized to receive the center tube 14 and the striking tube 16 in a nested fashion, as shown in FIG. 1. Specifically, the striking tube 16 is received within an axial bore 24 formed in the center tube 14, and the center tube 14 is received within the axial bore 22. A resilient, non-slip grip member 26 is adhered to the outer circumference of the gripping tube 12. A molded wear ring 27 is positioned in contact with the top edge of the grip member 26 to protect the grip member 26 during repeated use of the baton 10.

In the preferred embodiment of the invention, a closure cap 28 is threadedly received in the second end 20 of the gripping tube 12. The closure cap 28 includes an internal recessed well 30 that opens into the axial bore 22. The recessed well 30 is sized large enough to receive second end 32 of the striking tube 16 when the baton 10 is in the retracted position as shown in FIG. 1. A tapered inner wall 31 defines the well 30. The well 30 decreases in diameter from an outer lip 34 to a bottom wall 35. The tapered inner wall 31 smoothly guides the second end 32 of the striking tube 16 into the well 30 as the baton 10 is moved into its retracted position. The outer lip 34 contacts second end 36 of the center tube 14 to prevent further lateral movement of the center tube 14 within the axial bore 22 when the baton 10 is in the retracted position.

A resilient wire retainer 38 is attached to the bottom wall 35 of the closure cap 28 by an attachment member 40, such as the screw shown in FIG. 1. The wire retainer 38 extends from the closure cap 28 into the axial bore 22 and is compressed into contact with inner wall 42 of the striking tube 16 when the baton 10 is in the retracted position. The interaction between the wire retainer 38 and the inner wall 42 of the striking tube 16 exerts a retaining force to hold the tubes of the baton 10 in the retracted position. To extend the baton 10, an outward force must be applied to the striking tube 16 to overcome the retention force created by the wire retainer 38. The outward force can be applied by either swinging the baton in an arc to generate a centrifugal force or by grasping the end cap on the striking tube 16 and pulling the striking tube 16 from within the axial bore 22.

In the preferred embodiment of the invention, the gripping tube 12 is formed from 4130 CDN seamless alloy steel tubing having a minimum outer diameter of approximately 1.125 inches. The outer wall thickness of the gripping tube has a minimum thickness of approximately 0.065 inches along its entire length. The combination of the gripping tube 12 and the grip member 26 preferably creates an outer diameter of approximately 1.25 inches.

Figure 4:
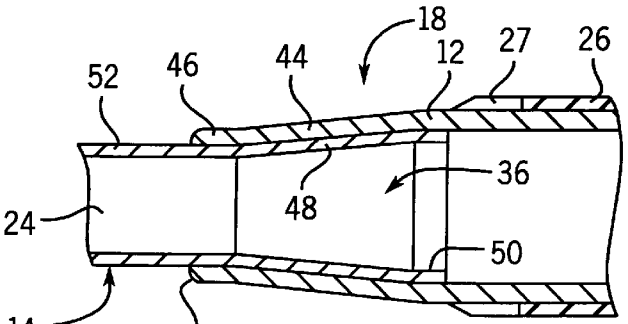
FIG. 4 is a partial section view of the area identified by line 4—4 in FIG. 2 illustrating the interaction between the second end of the center tube and the first end of the gripping tube of the expandable baton.

Referring now to FIGS. 1, 4 and 5, the first end 18 of the gripping tube 12 includes a tapered portion 44 and an extended support portion 46. The support portion 46 extends laterally from the tapered portion 44. In the preferred embodiment of the invention, the support portion 46 extends approximately ⅛ to ¼ inch from the tapered portion 44 and has a generally constant inner diameter D1. As can be seen in FIG. 5, the tapered portion 44 has an inner diameter that decreases from the inner diameter of the main body 47 of the gripping tube 12 to the reduced inner diameter D1 defined by the support portion 46.

In the preferred embodiment of the invention, the decreasing diameter of the tapered portion 44 is formed by a swagging process performed on the alloy steel tubing used to form the gripping tube 12. The extended constant inner diameter support portion 46 attached to the tapered portion 44 provides support to the swagged, tapered portion 44 to prevent the tapered portion 44 from expanding or cracking under the stress induced either when the baton 10 moves from the retracted position to the extended position or when the baton 10 is used to strike an object.

Unlike prior expandable batons, such as shown in U.S. Pat. No. 5,110,375, the gripping tube 12 need not be subjected to heat treating steps to increase the hardness of the gripping tube 12. Instead, the support portion 46 contained on the first end 18 of the gripping tube 12 provides the required strength to prevent the tapered portion 44 on the first end 18 of the gripping tube 12 from expanding or cracking under stress.

Referring again to FIG. 4, the second end 36 of the center tube 14 also includes a tapered portion 48 and a support portion 50 extending from the tapered portion 48. In the preferred embodiment of the invention, the support portion 50 extends approximately ⅛ to ¼ inch from the tapered portion 48 and has a generally constant inner diameter. As shown in FIG. 4, the inner diameter of the support portion 50 is larger than the inner diameter of the main body 52 of the center tube 14. When the baton 10 is in the extended position, the increasing diameter tapered portion 48 on the center tube 14 interacts with the decreasing diameter tapered portion 44 formed on the first end 18 of the gripping tube 12. The frictional interaction between these two members holds the center tube 14 and gripping tube 12 in their extended positions.

As was the case with the gripping tube 12, the center tube 14 is preferably formed from 4130 CDN seamless alloy steel tubing. The main body 52 of the center tube 14 preferably has a minimum outer diameter of 0.75 inches and has a wall thickness of at least 0.065 inches. The tapered portion 48 is formed by expanding the seamless alloy steel tubing. The extended support portion 50 formed on the second end 36 of the center tube 14 prevents cracking and compression of the tapered portion 48 during stress induced by extending the baton 10 or during use of the baton 10.

Figure 3:
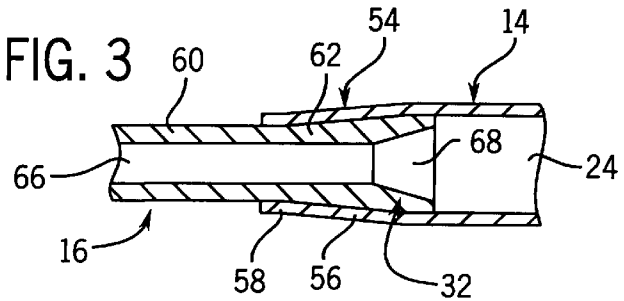
FIG. 3 is a partial section view of the area identified by line 3—3 in FIG. 2 illustrating the interaction between the second end of the striking tube and the first end of the center tube of the expandable baton.

Referring now to FIGS. 3 and 6, first end 54 of the center tube 14 includes a decreasing diameter tapered portion 56 and an extended support portion 58. In the preferred embodiment of the invention, the support portion 58 extends approximately ⅛ to ¼ inch from the end of the tapered portion 56 and has a generally constant inner diameter. The inner diameter of the support portion 58 is slightly larger than the outer diameter of main body 60 of the striking tube 16. The support portion 58 formed on the first end 54 of the center tube 14 aids in preventing cracking and strengthens the swagged portion of the alloy steel tubing forming the tapered portion 56.

As shown in FIG. 3, an increasing diameter tapered portion 62 is contained on the second end 32 of the striking tube 16. The outer diameter of the tapered portion 62 increases to a diameter greater than the inner diameter of the support portion 58 formed on the first end 54 of the center tube 14. When the baton 10 is in the extended position, the increasing diameter tapered portion 62 on the strike tube 16 interacts with the decreasing diameter tapered portion 56 formed on the first end 54 of the center tube 14. The frictional interaction between these two members holds the striking tube 16 and center tube 14 in their extended positions.

In the preferred embodiment of the invention, the striking tube 16 is machined from 4130 CDN seamless alloy steel tube or stronger material. Thus, unlike both the gripping tube 12 and the center tube 14, the tapered portion 62 contained on the second end 32 of the striking tube is not expanded or swagged, but rather is completely machined. Preferably, the wall thickness of the striking tube is approximately 0.080 throughout the main body 60 except for the tapered portion 62 contained on the second end 32. In the tapered portion 62, the wall thickness increases to a final minimum thickness of approximately 0.295 inches near the end of the striking tube 16. When the baton 10 is moved to the extended position, the tapered portion 62 of the striking tube 16 frictionally interacts with the inner surface of the tapered portion 56 of the center tube 14. The striking tube 16 is machined rather than expanded or swagged and the wall thickness increases throughout the tapered portion 62. Typically, the tapered portion 62 of the striking tube 16 is the area of the baton 10 subject to the greatest amount of stress during opening and striking. Since the striking tube 16 is machined, strength and cracking problems in this area are greatly reduced.

In the preferred embodiment of the invention, the striking tube 16 is machined from either a solid bar of metallic material or from a portion of steel tubing. Since the striking tube 16 is completely machined, no expanding or swagging is performed on the striking tube 16. The increasing wall thickness of the striking tube 16 in the tapered portion 62 is a result of the constant diameter axial bore 66 formed in the striking tube 16. An expanded diameter guide bore 68 is formed in alignment with the axial bore 66 and aids in guiding the wire retainer 38 into the striking tube 16 when the baton 10 is moved to the retracted position as shown in FIG. 1.

Since the striking tube 16 is completely machined rather than swagged or expanded in combination with a heat treating process, lightweight exotic metals, such as titanium, can be used to form the striking tube 16. An exotic metal such as titanium both increases the strength of the striking tube 16 while at the same time reducing the overall weight of the baton 10. Unlike alloy steel tubing, exotic materials such as titanium are not as easily swagged or expanded, thus greatly restricting their use in prior expandable batons. The machined striking tube 16 is stronger than prior art striking tubes and requires no subsequent hardening or strengthening steps.

In accordance with the invention, the support portions 46, 50 and 58 formed on the gripping tube 12 and center tube 14 increase the strength of the respective tube. The increased strength at these portions of each tube is required due to the swagging and expanding process used to form the tapered portions of each tube. Unlike prior art batons, heat treating the tubes used to form both the gripping tube 12 and the center tube 14 is no longer required to provide the required strength characteristics for the baton 10.

Referring now to FIGS. 1 and 7, an end cap 70 is connected to first end 72 of the striking tube 16. The end cap 70 generally includes a striking portion 74, a nesting portion 76 and an attachment shank 78. As can be seen in FIG. 1, the attachment shank 78 is threaded and received within a corresponding threaded bore 79 formed in the first end 72 of the striking tube 16. The threaded interaction between the attachment shank 78 and the striking tube 16 allows the end cap 70 to be removed from the striking tube 16 if desired.

In the preferred embodiment of the invention, the striking portion 74 has a generally circular outer circumference having an outer diameter as shown by D2 in FIGS. 1 and 7. The striking portion 74, and specifically front face 75, is one of the primary areas of the baton 10 that contacts a perpetrator when a law enforcement officer is using the baton 10 in a thrusting motion. In the preferred embodiment of the invention, the outer diameter D2 of the striking portion 74 is larger than the inner diameter D1 of the support portion 46 formed on the first end 18 of the gripping tube 12.

As can be understood in FIG. 1, when the baton 10 is in the retracted position, the striking portion 74 of the end cap 70 extends outward past an outer lip 79 of the support portion 46 contained on the first end 18 of the gripping tube 12. In this manner, the end cap 70 can be grasped by the law enforcement officer and used to extend the baton 10 to the extended position shown in FIG. 2. In prior batons, the entire end cap fits within the gripping tube, and to extend the baton, the baton must be swung sharply in an arc such that the inner telescoping sections are flung outward by the centrifugal force generated by the swinging action. However, if the law enforcement officer is in tight quarters, this swinging action may not be possible. Thus, by having at least a portion of the end cap 70 extending outward past the lip 79 of the gripping tube 12, law enforcement officers can grasp the end cap 70 and pull the striking tube 16 and center tube 14 outward to extend the baton 10.

Referring back to FIG. 7, the nesting portion 76 includes a nesting surface 80 and an angled surface 82. The nesting surface 80 is formed along the outer circumference of the nesting portion 76 and has an outer diameter D3 that is approximately equal to the inner diameter D1 of the support portion 46 formed on the first end 18 of the gripping tube 12. Thus, as can be understood in FIG. 1, the nesting surface 80 interacts with the inner wall of the support portion 46 to prevent the striking tube 16 from rattling within the gripping tube 12 when the baton 10 is in the retracted position. The angled surface 82 decreases in diameter from the nesting surface 80 to a stop surface 84. The angled surface 82 aids in guiding the nesting portion 76 into the first end 18 of the gripping tube 12 when the baton 10 is moved to its retracted position. In the retracted position, the first end 54 of the center tube 14 rests against the stop surface 84.

In the preferred embodiment of the invention, the outer diameter D2 of the end cap 70 is at least 1 inch and the end cap 70 is constructed from hardened metal. The relatively large diameter D2 of the end cap 70, as compared to prior art expandable batons, reduces the chances of puncture wounds and other injuries caused by jabbing the baton into a perpetrator or training bag. In an alternate embodiment of the invention, a portion of the end cap 70 can be removed to decrease the weight of the baton 10, as shown in phantom in FIG. 7.

As the baton 10 is moved into the retracted position, the wire retainer 38 is received within the guide bore 68 of the striking tube 16. The wire retainer 38 is compressed and enters into the axial bore 66 formed in the striking tube 16. As the striking tube 16 is further pushed into the axial bore 22 of the gripping tube 12, the second end 32 of the striking tube 16 contacts the tapered inner wall 31 of the closure cap 28. The tapered inner wall 31 guides the second end 32 of the striking tube 16 into the well 30 formed in the closure cap 28. Further movement of the striking tube 16 into the axial bore 22 causes the angled surface 82 on the end cap 70 to pass into the support portion 46 on the first end 18 of the gripping tube 12. The angled surface 82 guides the end cap into the position shown in FIG. 1, in which the nesting surface 80 engages the inner diameter of the support portion 46.

Various alternatives and embodiments are contemplated as being within the scope of the following claims particularly pointing out and distinctly claiming the subject matter regarded as the invention.

I claim:

1. A baton expandable between a retracted position and an extended position, comprising:

a gripping tube having an outer diameter and an axial bore formed therein, the gripping tube extending longitudinally between a first end and a second end, the first end having a support portion extending from a decreasing diameter tapered portion, the support portion having a generally constant inner diameter;

a center tube telescopingly slidable within the gripping tube, the center tube extending between a first end and a second end, the first end having a first support portion extending from a decreasing diameter tapered portion, the first support portion having a generally constant inner diameter, the second end of the center tube having a second support portion extending from an increasing diameter tapered portion, the second support portion having a generally constant inner diameter; and a striking tube telescopingly slidable within the center tube, the striking tube including a first end and a second end, the second end having an increasing diameter tapered portion.

2. The baton of claim 1 wherein the decreasing diameter tapered portion and support portion of the gripping tube frictionally engage the increasing diameter tapered portion and second support portion of the center tube when the center tube is fully extended.

3. The baton of claim 2 wherein the first support portion and decreasing diameter tapered portion on the first end of the center tube engage the increasing diameter tapered portion of the striking tube when the baton is in the extended position.

4. The baton of claim 1 further comprising an end cap attached to the first end of the striking tube, the end cap having an outer diameter greater than the inner diameter of the support portion formed on the first end of the gripping tube.

5. The baton of claim 4 wherein the end cap includes a striking portion and a nesting portion, the striking portion having an outer diameter greater than the inner diameter of the support portion formed on the first end of the gripping tube.

6. The baton of claim 5 wherein the nesting portion of the end cap includes a nesting surface having an outer diameter generally equal to the inner diameter of the support portion formed on the first end of the gripping tube, such, that the nesting surface is received within the support portion formed on the first end of the gripping tube when the baton is in the retracted position.

7. The baton of claim 1 wherein the striking tube is machined.

8. A baton expandable between a retracted position and an extended position, comprising:

a gripping tube having an outer diameter and an axial bore formed therein, the gripping tube extending longitudinally between a first end and a second end, the first end having a support portion extending from a decreasing diameter tapered portion, the support portion having a generally constant inner diameter;

a center tube telescopingly slidable within the gripping tube, the center tube extending between a first end and a second end, the first end having a first support portion extending from a decreasing diameter tapered portion, the first support portion having a generally constant inner diameter, the second end of the center tube having a second support portion extending from an increasing diameter tapered portion, the second support portion having a generally constant inner diameter;

a striking tube telescopingly slidable within the center tube, the striking tube including a first end and a second end, the second end having an increasing diameter tapered portion; and an end cap attached to the first end of the striking tube, the end cap including a striking portion and a nesting portion, the striking portion having an outer diameter greater than the inner diameter of the support portion formed on the first end of the gripping tube, the nesting portion including a nesting surface having an outer diameter generally equal to the inner diameter of the support portion formed on the first end of the grouping tube; and an angled surface joined to the nesting surface, the angled surface decreasing in diameter from the nesting surface, such that the nesting surface is received within the support portion formed on the first end of the gripping tube when the baton is in the retracted position.

9. The baton of claim 8 wherein the angled surface extends between the nesting surface and a stop surface, the stop surface contacting the first support portion of the center tube when the expandable baton is in its retracted position.

10. A baton expandable between a retracted position and an extended position, the baton comprising:

a gripping tube having an outer wall defining an axial bore extending between a first end and a second end, the first end of the gripping tube having an inner diameter and an outer diameter;

a striking tube telescopingly slidable into and out of the axial bore formed in the gripping tube, the striking tube having a first end and a second end; and an end cap attached to the first end of the striking tube, the end cap including a striking portion and a nesting portion, the outer diameter of the striking portion being greater than the inner diameter of the first end of the gripping tube, the nesting portion including a nesting surface having an outer diameter generally equal to the inner diameter of the first end of the gripping tube such that the nesting surface is received within the first end of the gripping tube and engages the outer wall of the first end of the gripping tube when the baton is in the retracted position.

11. The baton of claim 10 wherein the first end of the gripping tube section includes a tapered portion and a generally constant diameter support portion, wherein the inner diameter of the support portion is less than the outer diameter of the end cap.

12. The baton of claim 10 wherein the outer diameter of the end cap is at least 1.0 inches.

13. The baton of claim 10 wherein the end cap is threadedly attached to the first end of the striking tube.

14. A baton expandable between a retracted position and an extended position, the baton comprising:

a gripping tube having an outer wall defining an axial bore extending between a first end and a second end, the first end of the gripping tube having an inner diameter and an outer diameter;

a striking tube telescopingly slidable into and out of the axial bore formed in the gripping tube, the striking tube having a first end and a second end; and an end cap attached to the first end of the striking tube, the end cap including a striking portion and a nesting portion, the outer diameter of the striking portion being greater than the inner diameter of the first end of the gripping tube, the nesting portion including a nesting surface having an outer diameter generally equal to the inner diameter of the first end of the gripping tube such that the nesting surface engages the outer wall of the gripping tube when the baton is in the retracted position, the nesting portion further including an angled surface, the angled surface decreasing in diameter from the nesting surface to a stop surface, wherein the angled surface guides the first end of the gripping tube onto the nesting surface when the baton is moved into the retracted position.

15. The baton of claim 14 further comprising a center tube interposed between the gripping tube and the striking tube, the center tube having a first end and a second end, the first end of the center tube having an inner diameter less than the diameter of the stop surface of the end cap, such that the first end of the center tube contacts the stop surface on the end cap when the baton is in the retracted position.

16. A baton expandable between a retracted position and an extended position, the baton comprising:

a gripping tube having a first end and a second end, the first end including a decreasing diameter tapered portion and an extended support portion having an inner diameter;

a center tube telescopingly slidable within the gripping tube and having a first end and a second end, the first end of the center tube including a decreasing diameter tapered portion and an extended support portion, the second end of the center tube including an increasing diameter tapered portion and an extended support portion;

a striking tube telescopingly slidable within the center tube and having a first end and a second end, the second end of the striking tube including an increasing diameter tapered portion; and an end cap attached to the first end of the striking tube, the end cap including a striking portion and a nesting portion, the outer diameter of the striking portion being greater than the inner diameter of the extended support portion on the first end of the gripping tube, the nesting portion including a nesting surface having an outer diameter generally equal to the inner diameter of the extended support portion on the first end of the gripping tube such that the nesting surface is received within and engages the extended support portion formed on the first end of the gripping tube when the baton is in the retracted position.

17. The baton of claim 16 wherein the extended support portions formed on the gripping tube and the center tube each have a generally constant inner diameter.

18. A baton expandable between a retracted position and an extended position, the baton comprising:

a gripping tube having a first end and a second end, the first end including a decreasing diameter tapered portion and an extended support portion having an inner diameter;

a center tube telescopingly slidable within the gripping tube and having a first end and a second end, the first end of the center tube including a decreasing diameter tapered portion and an extended support portion, the second end of the center tube including an increasing diameter tapered portion and an extended support portion;

a striking tube telescopingly slidable within the center tube and having a first end and a second end, the second end of the striking tube including an increasing diameter tapered portion; and an end cap attached to the first end of the striking tube, the end cap including a striking portion and a nesting portion, the outer diameter of the striking portion being greater than the inner diameter of the extended support portion of the first end of the gripping tube, the nesting portion including a nesting surface having an outer diameter generally equal to the inner diameter of the extended support portion of the first end of the gripping tube such that the nesting surface is received within and engages the extended support portion formed on the first end of the gripping tube when the baton is in the retracted position, the nesting portion further including an angled surface, the angled surface decreasing in diameter from the nesting surface to a stop surface, such that the angled surface guides the first end of the gripping tube onto the nesting surface when the baton is moved into the retracted position.

19. A baton expandable between a retracted position and an extended position, the baton comprising:

a gripping tube having a first end and a second end, the first end including a decreasing diameter tapered portion and an extended support portion having an inner diameter;

a center tube telescopingly slidable within the gripping tube and having a first end and a second end, the first end of the center tube including a decreasing diameter tapered portion and an extended support portion, the second end of the center tube including an increasing diameter tapered portion and an extended support portion;

a striking tube telescopingly slidable within the center tube and having a first end and a second end, the second end of the striking tube including an increasing diameter tapered portion;

an end cap attached to the first end of the striking tube, the end cap having an outer diameter that is greater than the inner diameter of the extended support portion formed on the first end of the gripping tube; and a closure cap attached to the second end of the gripping tube, the closure cap including a well sized to receive the second end of the striking tube when the baton is in the retracted position.

20. The baton of claim 19 wherein the well formed in the closure cap is defined by a tapered inner wall such that the diameter of the well decreases from an outer lip to an end wall, such that the tapered inner wall guides the second end of the striking tube into the well.

* * * * *